US011154131B2

(12) United States Patent
Seibel

(10) Patent No.: US 11,154,131 B2
(45) Date of Patent: Oct. 26, 2021

(54) SIDE DEPLOYABLE KEYBOARD TRAY SYSTEM

(71) Applicant: Barry Seibel, Pacific Palisades, CA (US)

(72) Inventor: Barry Seibel, Pacific Palisades, CA (US)

( * ) Notice: Subject to any disclaimer, the term of this patent is extended or adjusted under 35 U.S.C. 154(b) by 0 days.

(21) Appl. No.: 16/680,363

(22) Filed: Nov. 11, 2019

(65) Prior Publication Data

US 2020/0093261 A1 Mar. 26, 2020

Related U.S. Application Data

(60) Provisional application No. 62/733,987, filed on Sep. 20, 2018.

(51) Int. Cl.
*A47B 21/03* (2006.01)
*A47B 21/02* (2006.01)

(52) U.S. Cl.
CPC ..... *A47B 21/0314* (2013.01); *A47B 21/02* (2013.01); *A47B 2021/0335* (2013.01); *A47B 2200/0046* (2013.01)

(58) Field of Classification Search
CPC ..... A47B 21/0314; A47B 2021/0321; A47B 2021/0328; A47B 2021/0335; A47B 2021/0357; A47B 2021/0392; A47B 2200/0089
See application file for complete search history.

(56) References Cited

U.S. PATENT DOCUMENTS

| | | | | | |
|---|---|---|---|---|---|
| 2,037,919 | A * | 4/1936 | Poe | A47B 17/06 | 108/93 |
| 2,293,496 | A * | 8/1942 | Egger | A47B 1/00 | 108/93 |
| 2,650,871 | A * | 9/1953 | Holderegger | A47B 88/48 | 312/322 |
| 5,248,192 | A * | 9/1993 | Tazzia | A47B 17/03 | 312/194 |
| 5,595,428 | A * | 1/1997 | Huang | A47B 21/0314 | 312/223.3 |
| 5,947,035 | A * | 9/1999 | Chang | A47B 17/06 | 108/143 |
| 6,206,495 | B1 * | 3/2001 | Peterson | A47B 21/0314 | 312/249.13 |
| 7,048,236 | B2 * | 5/2006 | Benden | A47B 21/0314 | 108/138 |
| 9,788,646 | B2 * | 10/2017 | Halde | A47B 17/065 | |
| 9,999,294 | B2 * | 6/2018 | Leverett, Sr. | F16C 29/008 | |
| 10,206,499 | B2 * | 2/2019 | Purifoy | A47B 97/00 | |
| 2012/0298017 | A1 * | 11/2012 | Chen | A47B 17/065 | 108/91 |
| 2013/0284075 | A1 * | 10/2013 | Reithler | A47B 46/00 | 108/91 |
| 2017/0367475 | A1 * | 12/2017 | Gonzalez | A47B 17/065 | |

* cited by examiner

*Primary Examiner* — Daniel J Rohrhoff
(74) *Attorney, Agent, or Firm* — Merle W. Richman, III

(57) ABSTRACT

Embodiments of a side deployable keyboard tray systems that may include a height adjustment system. Other embodiments may be described and claimed.

19 Claims, 5 Drawing Sheets

FIGURE 1A – PRIOR ART

SIDE DEPLOYABLE KEYBOARD TRAY SYSTEM

TECHNICAL FIELD

Various embodiments described herein relate to trays for computer keyboards.

BACKGROUND INFORMATION

It may be desirable to provide a deployable tray for a computer keyboard; the present invention provides an improved deployable tray system for computer keyboards.

BRIEF DESCRIPTION OF THE DRAWINGS

FIG. 1A is a top view of a work environment including a computer system with keyboard according to various embodiments.

DETAILED DESCRIPTION

Figure 1B:
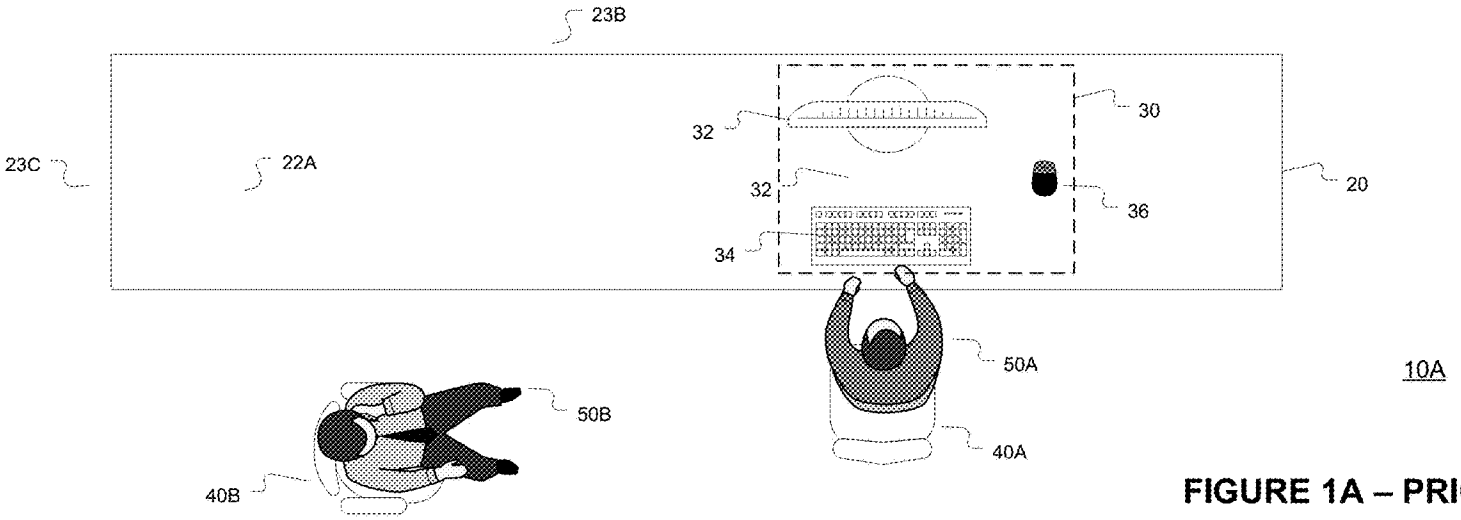
FIG. 1B is a top view of a work environment including a computer system with a side deployable keyboard tray system according to various embodiments.
Figure 1B:
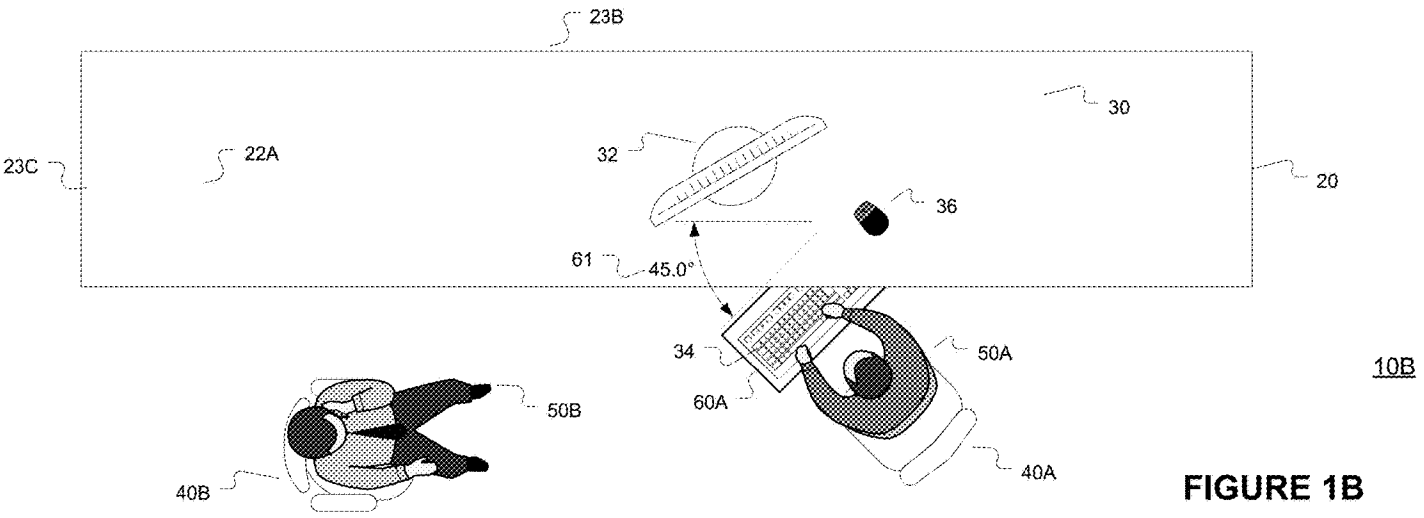

FIG. 1A is a top view of a work environment 10A including a computer system 30 including a keyboard 34 according to various embodiments. A work environment 10A may commonly include a computer system 30 that may be employed by a User 50A as part of their work or employment. The User 50A may also need to interact with another employee or client 50B as part of their work or employment. The User 50A may be seated on a chair 40A and the other employee or client 50B may also be seated on a chair 40B in an embodiment. As shown in FIG. 1A, a computer system 30 may include a monitor 32, mouse 36, and keyboard 34. The computer system 30 may include a separate housing for the main processor and memory or may be part of the monitor 32 in an embodiment. The computer system 30 may be placed on a desk 20. In an embodiment, the keyboard 34 may be a wired or wireless keyboard that form an input source for any electronic device including a desktop computer, monitor, television, tablet, mobile device, or any other electronic that may be coupled to the keyboard 34 to provide input therein via a wired or wireless connection.

The work environment 10A configuration show in FIG. 1A, may make it difficult for the User 50A to interact with the other User, employee, or client 50B while using the computer system 30. Such a work environment 10A may limit desired or desirable interactions between the User 50A and the other User, employee, or client 50B. Such an interaction limitation may be particularly problematic where the User 50A is providing services for the other User, employee, or client 50B while using the computer system 30. The present invention provides a work environment 10B (FIG. 1B) that is more conductive for personal interaction between the User 50A and the other User, employee, or client 50B while the User 50A employs a computer system 30.

FIG. 1B is a top view of a work environment 10B including a computer system 30 with a side deployable keyboard tray system 60A according to various embodiments. As shown in FIG. 1B, a keyboard 34 of a computer system 30 may be stored in a side deployable tray system 60A. The side deployable tray system 60A enables the User 50A to be oriented at angle 61 relative to the desk 20 long side 23C and more directly at the other User, employee, or client 50B while using the computer system 30. In an embodiment, the angle 61 may be about 15 degrees to 160 agrees and about 30 degrees to 90 degrees as a function of the keyboard 34 user 50A. The inclusion of the side deployable tray system 60A in the work environment 10B may enable a more conductive personal interaction between the User 50A and the other User, employee, or client 50B while the User 50A employs a computer system 30.

Figure 1C:
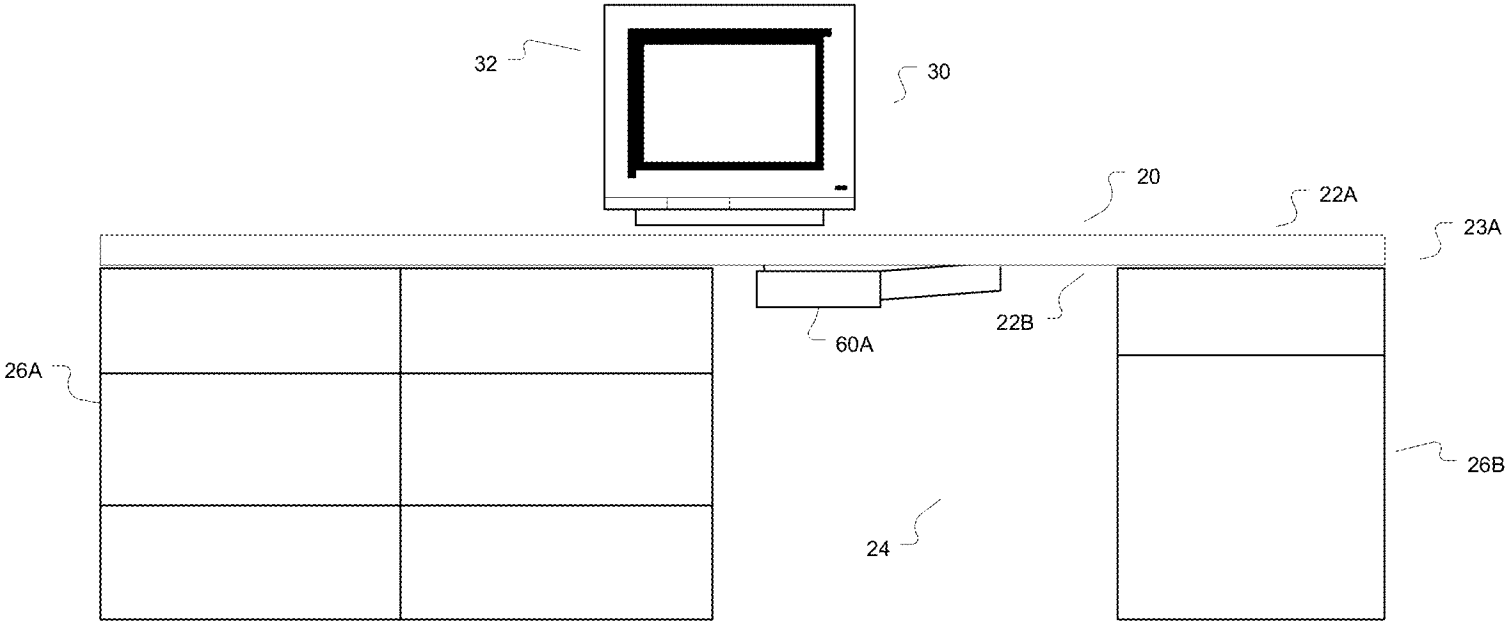
FIG. 1C is a front view of a desk architecture including a computer system with a side deployable keyboard tray system according to various embodiments.

FIG. 1C is a front view of a desk architecture 10C including a computer system 30 with a side deployable keyboard tray system 60A according to various embodiments. As shown in FIG. 1C, the desk architecture 10C may include a desk 20, a computer system 30, and a side deployable keyboard tray system 60A. The desk 20 may include table top 22A having a long planar surface 22A (as shown in FIGS. 1A and 1B), a left pedestal 26A with drawers or cabinets, and a right pedestal 26B with drawers or cabinets. The left and right pedestals 26A, 26B may form an opening 24 for a User's 50A legs. As shown in FIGS. 1A-1C, the desk 20 may a first side 23B having a first length and a second side 23C having a second length. In an embodiment desk's 20 first side 23B first length may be greater than the second side's 23C second length. The desk 20 may also have a thickness 23A. In an embodiment, the first side 23B first length may be from about 3 feet to 9 feet and the second side's 23C second length may be from about 2.5 feet to 6 feet in an embodiment. The desk 20 may also have a thickness 23A of about 0.5 inches to 9 inches in an embodiment.

In an embodiment, the side deployable keyboard tray system 60A may be coupled to the underside 22B of the desk's long planar surface 22A defined by sides 23B and 23C. In one embodiment, a side deployable keyboard tray system (SDKTS) 60A may be rotatably coupled to the underside 22B of the desk's long planar surface 22A as show in FIGS. 2A and 2B, enabling a User 50A to change the angle of side deployment relative to the desk's long planar surface 22A. In another embodiment, a side deployable keyboard tray system (SDKTS) 60B may be fixably coupled to the underside 22B of the desk's long planar surface 22A as show in FIGS. 3A and 3B, providing a fixed angle of deployment of the system 60B relative to the desk's long planar surface 22A.

In an embodiment, a SDKTS 60A, 60B may be employed so it may extend at non-parallel angle relative the side 23B, 23C which is coupled. The length of the SDKTS 60A, 60B may enable it to be completely concealed beneath the underside 22B of the desk 20A, i.e., the SDKTS 60A. 60B side length 62A may be less than the desk's 20 first side 23B first length and the second side 23C second length.

Figure 2A:
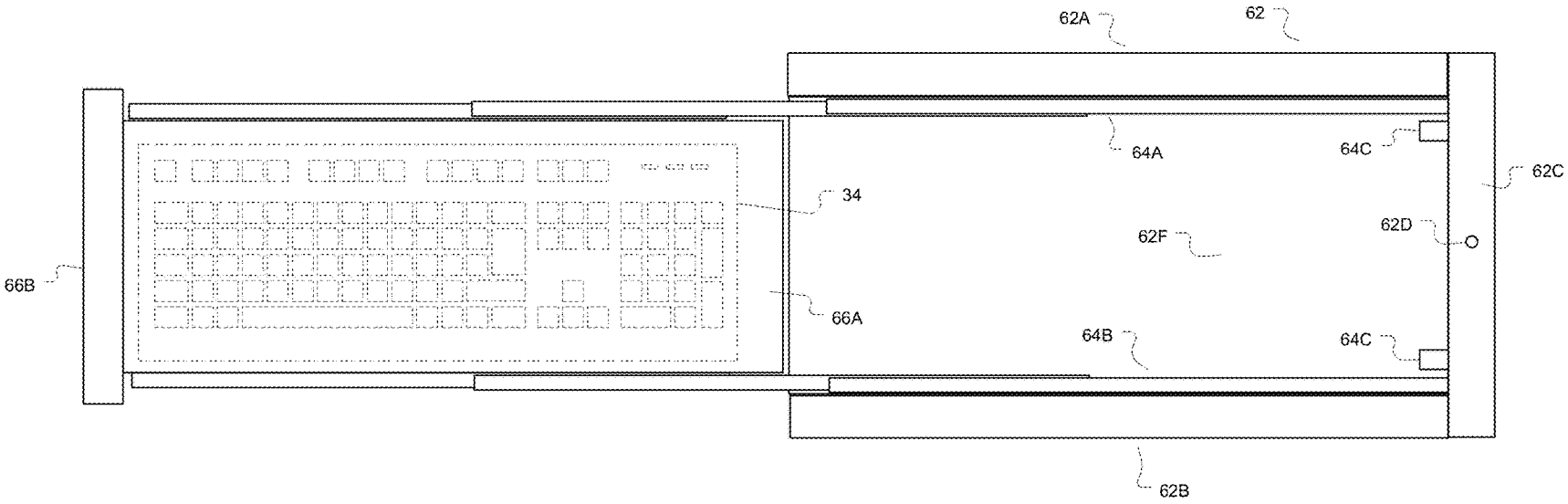
FIG. 2A is a simplified top view diagram of a side deployable keyboard tray system fully extended or deployed according to various embodiments.
Figure 2B:
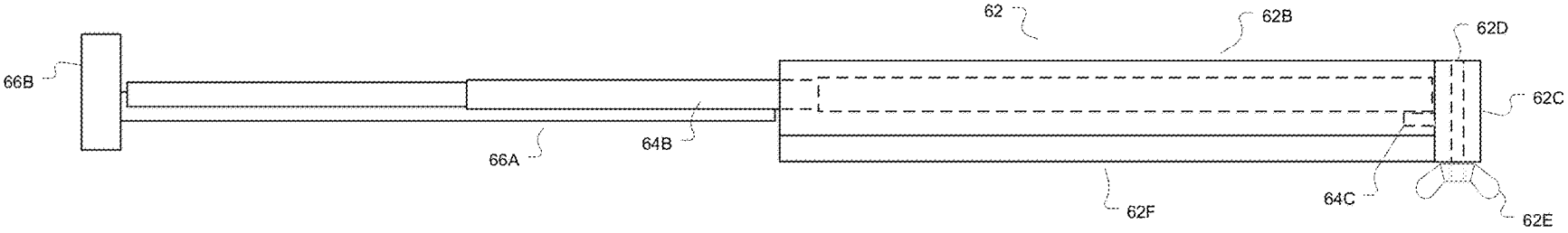
FIG. 2B is a simplified side view diagram of the side deployable keyboard tray system shown in FIG. 2A according to various embodiments.

FIG. 2A is a simplified top view diagram of a side deployable keyboard tray system 60A fully extended or deployed according to various embodiments. FIG. 2B is a simplified side view diagram of the side deployable keyboard tray system (SDKTS) 60A shown in FIG. 2A according to various embodiments. As shown in FIGS. 2A and 2B, the SDKTS 60A may include a planar keyboard tray 66A coupled to an arm 66B that are slidably coupled a base 62 via a left nested rail 64A and a right nested rail 64B. The SDKTS 60A base 62 may include a planar bottom 62F coupled to a left rail arm 62A, a right rail arm 62B, and a back-desk engagement arm 62C. In an embodiment, the left and right rails 64A, 64B include multiple nestable sections that enable a User 50A to slidably move the keyboard tray 66A from a nested or closed position within the base 62 to a fully extended or deployed position as shown in FIGS. 2A and 2B by a User 50A engaging the arm or handle 66B.

As shown in FIG. 2B, the arm's 66B vertical length may extend below the keyboard tray 66A to enable a User 50A to more easily deploy the keyboard tray 66A when it is nested within the base 62. As shown in FIGS. 2A and 2B, the base 62 may also include one or more stops 64C that limit return or nesting of the keyboard tray 66A. The stops 64C may be formed of a resilient material including rubber or coiled spring(s). The back 62C of the base 62 may include a fenestration 62D that extends from its top side to bottom to enable a screw or bolt to extend to a desk 20 bottom side 22B and rotatably couple the SDKTS 60A to the desk 20 and lock its position via a locking mechanism 62E (such as a nut or thumb nut in an embodiment). As shown in FIG. 2A, the keyboard tray 66A may be sized to completely nest a keyboard 34. In an embodiment a keyboard 34 may have a width from about 3 to 9 inches, a length of about 11 to 20 inches, and a height from about 0.5 inches to 3 inches. In an embodiment the SDKTS 60A, 60B, tray 66A may be greater in width and length than the keyboard 34 and may have a width from about 3 to 14 inches, a length of about 11 to 26 inches. In an embodiment the SDKTS 60A, 60B the distance between the arms 62A, 62B may be greater than the tray 66A width. In an embodiment the SDKTS 60A, 60B the height of the arms 62A, 62B may be greater than the keyboard 34 height and about 2 to 6 inches so the tray 66A extends about 0.5 to 4 inches from the underside 22B of a surface 20 when deployed thereon. In an embodiment the SDKTS 60A, 60B may be formed of man-made materials, natural materials, or combinations thereof.

Figure 3A:
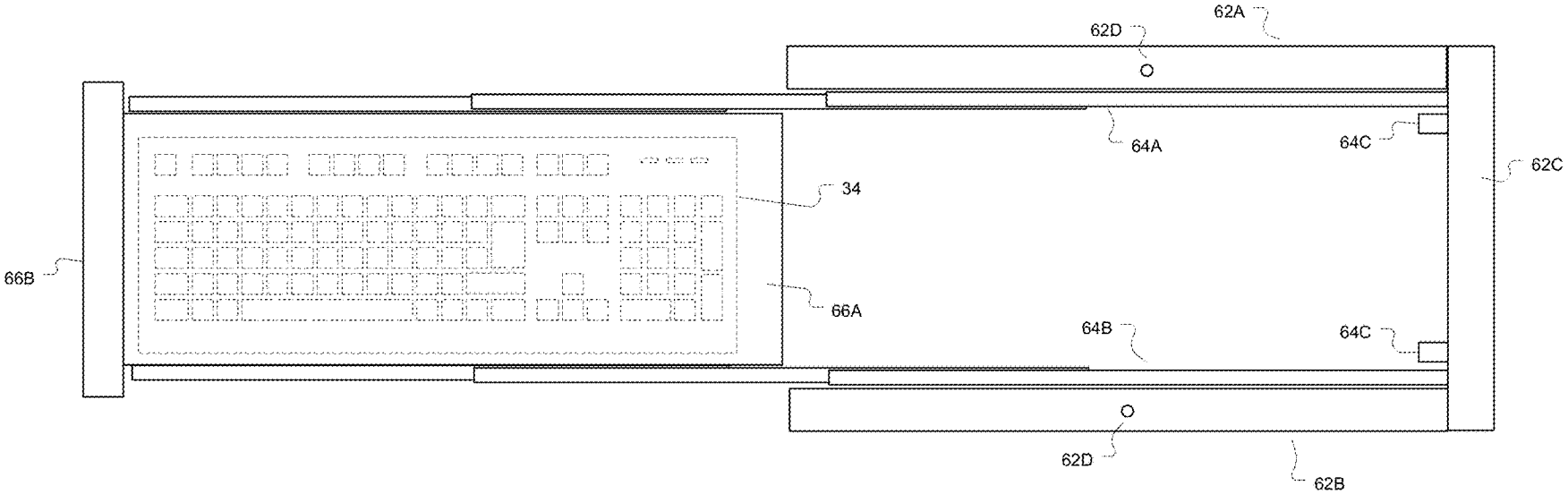
FIG. 3A is a simplified top view diagram of another side deployable keyboard tray system fully extended or deployed according to various embodiments.
Figure 3B:
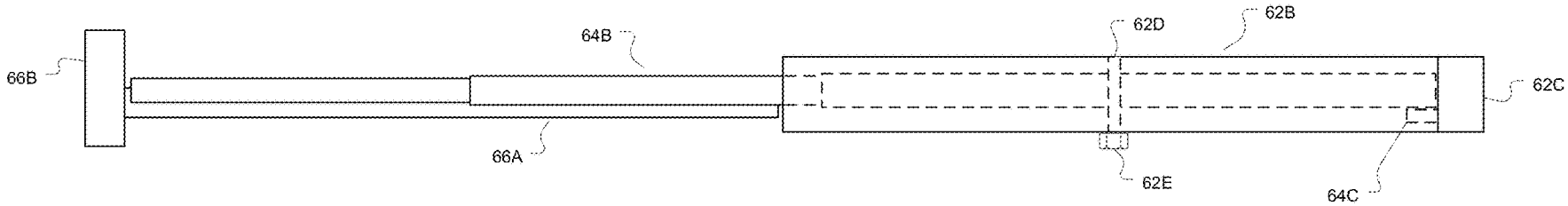
FIG. 3B is a simplified side view diagram of the side deployable keyboard tray system shown in FIG. 3A according to various embodiments.

FIG. 3A is a simplified top view diagram of another side deployable keyboard tray system 60B fully extended or deployed according to various embodiments. FIG. 3B is a simplified side view diagram of the side deployable keyboard tray system (SDKTS) 60B shown in FIG. 3A according to various embodiments. As shown in FIGS. 3A and 3B, the SDKTS 60B may also include a planar keyboard tray 66A coupled to an arm 66B that are slidably coupled a base 62 via a left nested rail 64A and a right nested rail 64B. The SDKTS 60A base 62 may or may not include a planar bottom 62F coupled to a left rail and desk engagement arm 62A, a right rail and desk engagement arm 62B, and a back arm 62C.

Figure 4:
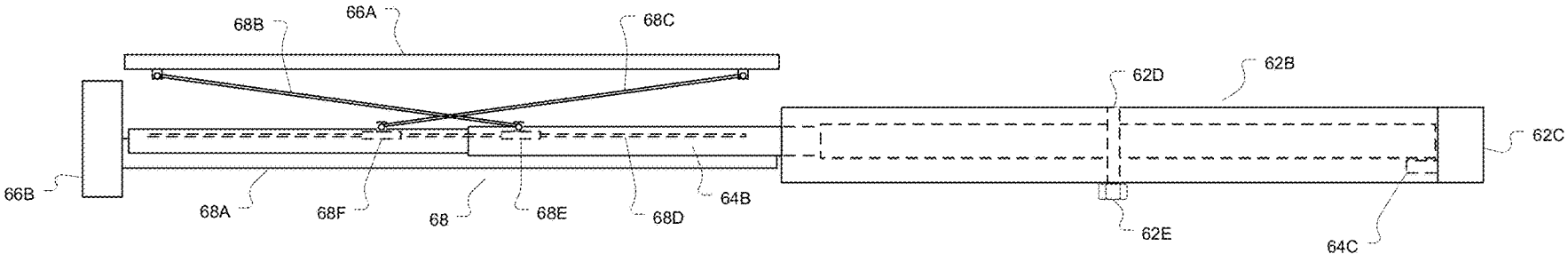
FIG. 4 is a simplified side view diagram of another side deployable keyboard tray system fully extended or deployed with a height adjustment system according to various embodiments.

In the SDKTS 60B, the left rail and desk engagement arm 62A and the right rail and desk engagement arm 62B may each include a fenestration 62D that extends from its top side to bottom to enable a screw or bolt to extend to a desk 20 bottom side 22B and fixably couple the SDKTS 60A to the desk 20 and lock its position via a locking mechanism 62E (such as a nut or thumb nut in an embodiment). FIG. 4 is a simplified side view diagram of another side deployable keyboard tray system 60C fully extended or deployed with a height adjustment system according to various embodiments.

The SDKTS 60A, 60B back 62C and arms 62A, 62B length may be greater than the width and the length of a keyboard 34 to be stored and deployed therein. Such a configuration may enable the SDKTS 60A, 60B and a keyboard 34 stored therein to be concealed under the surface 22B of a desk 20 when the keyboard 34 is not in use. In an embodiment, a keyboard 34 and the SDKTS 60A, 60B may be rectangular in shape where the arms 62A, 62B are longer in length than the back 62C.

As shown in FIG. 4, the SDKTS 60C, the keyboard tray 66A may be coupled to a height adjustable system 68. The height adjustable system 68 may include a planar base 68A that is coupled to the left and right rails 64B. The height adjustable system 68 may include other components that enable a User 50A to adjust the height of the keyboard tray 66A from a lowest, nested position to a vertical maximum height. In an embodiment, the vertical maximum height may be at least the height of the desk's 20 top surface 22A. As shown in FIG. 4, the height adjustment system 68 may include a scissor function including a left scissor arm 68B pivotably coupled to the keyboard tray 66A and a rail car 68E on a rail 68D and a right scissor arm 68C pivotably coupled to the keyboard tray 66A and a rail car 68F on a rail 68D. The rail 68D may be coupled to the top surface of the planar base 68A. The rail cars 68E and 68F may also be coupled to the springs to hold the planar keyboard tray 66A at a desired height once set by a User 50A.

The accompanying drawings that form a part hereof show, by way of illustration and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. An electronic input device holding apparatus for coupling to the underside of a flat surface, the flat surface having a length and a width and the electronic input device having a maximum length, width, and height, including:

a tray sized to have a width and a length greater than the electronic input device's maximum width and length, the tray length greater than the tray width; and a base having a width and a length greater than the tray, wherein the tray only engages the base and is slidably coupled to the base so the tray may be nested substantially within and below the base and the tray may be deployed along its length below the underside of the flat surface, the base configured to be rotatably and securely couplable to only the underside of the flat surface.

2. The electronic input device holding apparatus of claim 1, wherein the combination of the tray and base are sized to create a space having a height greater than the electronic input device height when the base is rotatably and securely coupled to the underside of the flat surface.

3. The electronic input device holding apparatus of claim 1, wherein the flat surface has a long edge and the base is configured to be rotatably and securely couplable to the underside of the flat surface so that when the tray is deployed along its length it is at an angle of at least 20 to 80 degrees relative to the flat surface long edge.

4. The electronic input device holding apparatus of claim 1, wherein the tray is substantially rectangular in shape.

5. The electronic input device holding apparatus of claim 1, wherein the base includes a left arm, a right arm, and a back coupling the left arm to the right arm and forming a space where the tray may be substantially nested therein.

6. The electronic input device holding apparatus of claim 5, wherein the base back is configured to be rotatably and securely couplable to the underside of the flat surface.

7. The electronic input device holding apparatus of claim 5, wherein the electronic input device is an alphanumeric keyboard.

8. The electronic input device holding apparatus of claim 1, wherein the tray is movable in a vertical and parallel direction relative to the base length once extended from the base.

9. The electronic input device holding apparatus of claim 1, wherein the tray is slidably coupled to the base via a rail.

10. The electronic input device holding apparatus of claim 5, wherein the tray is slidably coupled to the base via a rail on the left arm and a rail on the right arm.

11. An electronic input device holding apparatus for coupling to the underside of a flat surface, the flat surface having a length and a width and the electronic input device having a maximum length, width, and height, including:

a tray sized to have a width and a length greater than the electronic input device's maximum width and length, the tray length greater than the tray width;

a base having a width and a length greater than the tray, wherein the tray is slidably coupled to the base so the tray may be nested substantially within and below the base and the tray may be deployed along its length below the underside of the flat surface and only engages the base, wherein the flat surface has a long edge and the base is configured to be securely couplable to only the underside of the flat surface so that when the tray is deployed along its length it is at an angle of about 20 to 80 degrees relative to the flat surface long edge.

12. The electronic input device holding apparatus of claim 11, wherein the combination of the tray and base are sized to create a space having a height greater than the electronic input device height when the base is securely coupled to the underside of the flat surface.

13. The electronic input device holding apparatus of claim 11, wherein the base includes a left arm, a right arm, and a back coupling the left arm to the right arm and forming a space where the tray may be nested substantially therein.

14. The electronic input device holding apparatus of claim 11, wherein the tray is substantially rectangular in shape.

15. The electronic input device holding apparatus of claim 14, wherein the right arm and the left arm are configured to be securely couplable to the underside of the flat surface.

16. The electronic input device holding apparatus of claim 14, wherein the electronic input device is an alphanumeric keyboard.

17. The electronic input device holding apparatus of claim 11, wherein the tray is movable in a vertical and parallel direction relative to the base length once extended from the base.

18. The electronic input device holding apparatus of claim 11, wherein the tray is slidably coupled to the base via a rail.

19. The electronic input device holding apparatus of claim 15, wherein the tray is slidably coupled to the base via a rail on the left arm and a rail on the right arm.

* * * * *